US011452664B2

(12) United States Patent
Turner et al.

(10) Patent No.: US 11,452,664 B2
(45) Date of Patent: Sep. 27, 2022

(54) LIMB REHABILITATION DEVICE

(71) Applicant: KUSU INC., Calgary (CA)

(72) Inventors: Peter Anthony Turner, Blind Bay (CA); Dino Gradilone, Calgary (CA)

(73) Assignee: KUSU INC., Calgary (CA)

( * ) Notice: Subject to any disclaimer, the term of this patent is extended or adjusted under 35 U.S.C. 154(b) by 625 days.

(21) Appl. No.: 15/585,416

(22) PCT Filed: Nov. 3, 2015

(86) PCT No.: PCT/CA2015/000566

§ 371 (c)(1),
(2) Date: May 3, 2017

(87) PCT Pub. No.: WO2016/070264

PCT Pub. Date: May 12, 2016

(65) Prior Publication Data

US 2017/0258671 A1 Sep. 14, 2017

Related U.S. Application Data

(60) Provisional application No. 62/074,380, filed on Nov. 3, 2014.

(51) Int. Cl.
*A61H 7/00* (2006.01)
*A61H 15/00* (2006.01)

(52) U.S. Cl.
CPC ..... *A61H 7/008* (2013.01); *A61H 2015/005* (2013.01); *A61H 2015/0042* (2013.01);
(Continued)

(58) Field of Classification Search
CPC ..... A61H 7/00; A61H 7/007; A61H 7/008; A61H 15/00; A61H 2015/0007;
(Continued)

(56) References Cited

U.S. PATENT DOCUMENTS 2,219,138 A 10/1940 Morrison
2,223,263 A * 11/1940 Michaelson ..... A61H 15/00 601/128

(Continued)

FOREIGN PATENT DOCUMENTS

CH 664486 A5 * 3/1988 ..... A61H 15/0092
GB 277485 A * 9/1927 ..... A61H 15/0092

(Continued)

OTHER PUBLICATIONS

PCT—International Search Report issued by ISA/CA—Canadian Intellectual Property Office dated Jan. 27, 2016.

(Continued)

*Primary Examiner* — Justine R Yu
*Assistant Examiner* — Matthew D Ziegler
(74) *Attorney, Agent, or Firm* — Gowling WLG (Canada) LLP

(57) ABSTRACT

A limb rehabilitation device has a plurality of rollers with cups. The rollers are mounted on spring mounts. The forearm or another limb may be placed between the rollers for therapeutic massage of the limb and the soft tissue thereon. The cups of the rollers aim to produce compression, shearing, and lifting of the tissue.

25 Claims, 7 Drawing Sheets

(52) U.S. Cl.
CPC ..... *A61H 2201/013* (2013.01); *A61H 2201/0153* (2013.01); *A61H 2201/0207* (2013.01); *A61H 2201/0214* (2013.01); *A61H 2201/0257* (2013.01); *A61H 2201/164* (2013.01); *A61H 2201/1635* (2013.01)

(58) Field of Classification Search
CPC .... A61H 2015/0014; A61H 2015/0021; A61H 2015/0042; A61H 2015/005; A61H 2201/013; A61H 2201/0153; A61H 2201/0207; A61H 2201/0214; A61H 2201/0257; A61H 2201/0192; A61H 2201/1253; A61H 2201/1635; A61H 2201/164; A61H 2205/06; A61H 2205/065; A61H 2007/009; A61H 2015/0057; A61H 2015/0028; A61H 15/0092; A61H 2205/067; A61H 2205/10; A61H 2205/106; A61H 2205/108; A61H 2205/12
See application file for complete search history.

(56) References Cited

U.S. PATENT DOCUMENTS 2,230,890 A * 2/1941 McClenathen ..... A61H 15/00 601/122
2,959,167 A * 11/1960 Leclabart ..... A61H 7/00 601/133
3,465,750 A * 9/1969 Schawalder ..... A61H 15/00 601/122
3,942,791 A * 3/1976 Dawson ..... A61H 15/00 242/140
4,039,183 A * 8/1977 Sakurada ..... A63B 23/14 482/46
4,191,177 A * 3/1980 Abbott ..... A61H 1/00 601/125
4,310,154 A * 1/1982 Kauffman ..... A63B 23/14 482/46
4,589,655 A * 5/1986 Ammon ..... A63B 21/0004 482/46
4,662,356 A * 5/1987 Aronsohn ..... A61B 17/2812 128/898
5,358,471 A * 10/1994 Klotz ..... A61F 5/013 602/16
5,364,323 A * 11/1994 Liu ..... A63B 23/14 482/124
5,792,081 A * 8/1998 Cross ..... A61H 15/0092 601/123
5,851,166 A * 12/1998 Bernardson ..... A63B 22/16 482/79
6,068,605 A * 5/2000 Bjornsti ..... A61H 15/00 601/119
6,607,499 B1 * 8/2003 Becher ..... A61H 7/007 601/101
8,678,984 B1 * 3/2014 Poillucci ..... A61H 1/0285 482/124
9,125,791 B2 * 9/2015 Collins ..... A61H 15/00
9,622,937 B2 * 4/2017 Nelson ..... A61H 15/0092
2005/0159688 A1 * 7/2005 Sakamoto ..... A61H 15/0092 601/123
2009/0197741 A1 * 8/2009 Poillucci ..... A61H 1/0285 482/44
2011/0237987 A1 * 9/2011 Du ..... A61H 15/00 601/24
2012/0203151 A1 8/2012 Kleiman
2013/0018290 A1 * 1/2013 Holdorf ..... A61H 15/0092 601/128
2013/0245509 A1 * 9/2013 Tanigawa ..... A61H 15/0092 601/20
2014/0039363 A1 * 2/2014 Johnston ..... A61H 7/007 601/135
2014/0113771 A1 * 4/2014 Kubik ..... A63B 23/03 482/11

FOREIGN PATENT DOCUMENTS

GB 2284548 A * 6/1995
SU 1149974 A1 * 4/1985

OTHER PUBLICATIONS

PCT—Written Opinion of the Internatoinal Searching Authority issued by SA/CA—Canadian Intellectual Property Office dated Jan. 27, 2016.
Canadian Intellectual Property Office—Office Action dated Sep. 14, 2018 for Canadian patent application No. 2,975,281.
Canadian Intellectual Property Office—Office Action dated Jun. 19, 2019 for corresponding Canadian patent application No. 2,975,281.

* cited by examiner

LIMB REHABILITATION DEVICE

FIELD OF THE INVENTION

The present invention relates to a limb rehabilitation device. More specifically, the invention relates to a rehabilitation device for the forearm.

BACKGROUND OF THE INVENTION

Injuries to the wrist, the forearm and the elbow can include a variety of soft tissue injuries such as sprains, strains, and over-use injuries such as carpal tunnel syndrome (CTS) and/or tendinopathy of the extensor/supinator muscles (also sometimes referred to as lateral epicondyltitis or "tennis elbow" or medial epicondylitis or "golfer's elbow"). These injuries can produce pain, swelling, and reduced range of motion in the affected part.

Tissue massage and soft tissue manipulation can be used to provide therapeutic relief for various types of soft tissue injuries. Massage and manipulation of the tissue can help to promote blood and lymphatic circulation, maintain range of motion of the joint, reduce swelling and stimulate stretch reflexes in muscles.

Massage and soft tissue manipulation can be self-administered, or can be performed by a massage therapist, a physiotherapist, or an osteopath who may manually manipulate the soft tissue with compression, stretching, twisting and shearing motions. A more specific manipulation may aim to lift the skin, the fascia and the superficial soft tissue. This may include myofascial release.

Various devices also exist to aid with massage and soft tissue manipulation. These include a variety of roller devices. Some such roller devices have rollers only on one side of the forearm or other limb; for example, US2009/0197741 titled "Hand, Wrist and Arm Therapy and Exercising" by Poillucci and US2004/0089771 titled "Ergonomic And Massaging Computer Interface Support Surfaces" by Pap both rely on the weight of the limb or pressure by the user against the rollers. In practise, the force against the rollers is variable and inconsistent. When the force is self-imposed by the user, it is always limited by the user. This is particularly pronounced when injury of the limb leads to sensitization of the limb and the user tends to use smaller pressures. These small pressures may result in reduced therapeutic effect.

There are roller devices with opposing rollers such as the device described in US2012/0203151 titled "Arm, Wrist And Hand Treatment Device And Method" by Kleiman, which has two opposing rollers through which the hand, wrist and forearm are inserted and withdrawn for deep tissue massage. The opposing rollers allow more consistent roller pressure to be administered, and if appropriate larger pressures than would be consistently self-administered. The Kleiman device requires stabilization by the other hand and the position of the rollers can be adjusted, but the only force produced on the skin is compression. The Kleiman device produces compression across a broad area and it is not configured to avoid compression of delicate or irritated areas of the forearm such as nerves, arteries and bony prominences.

The above described devices are not designed to twist or lift the skin and soft tissue.

SUMMARY OF THE INVENTION

In one broad aspect of the present invention, there is provided a limb rehabilitation device comprising a plurality of rollers with cups and the rollers are mounted on spring mounts. The forearm or another limb can be placed between the rollers for therapeutic massage of the limb and the soft tissue thereon. The cups of the rollers aim to produce compression, shearing, and lifting of the tissue.

In one embodiment, a limb rehabilitation device is provided, comprising a first frame having a first pivot point, a second pivot point, and at least one therapeutic component rotatably supported thereon, the at least one therapeutic component being rotatable about a first rotational axis, the second pivot point being at or near the first rotational axis; at least one elastic member; and a second frame having a first pivot point, a second pivot point, and at least one therapeutic component rotatably supported thereon, the at least one therapeutic component being rotatable about a second rotational axis, and the second pivot point being at or near the second rotational axis, the second frame being pivotally connected to the first frame at the first pivot points and elastically connected to the first frame at the second pivot points by the at least one elastic member.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 1:
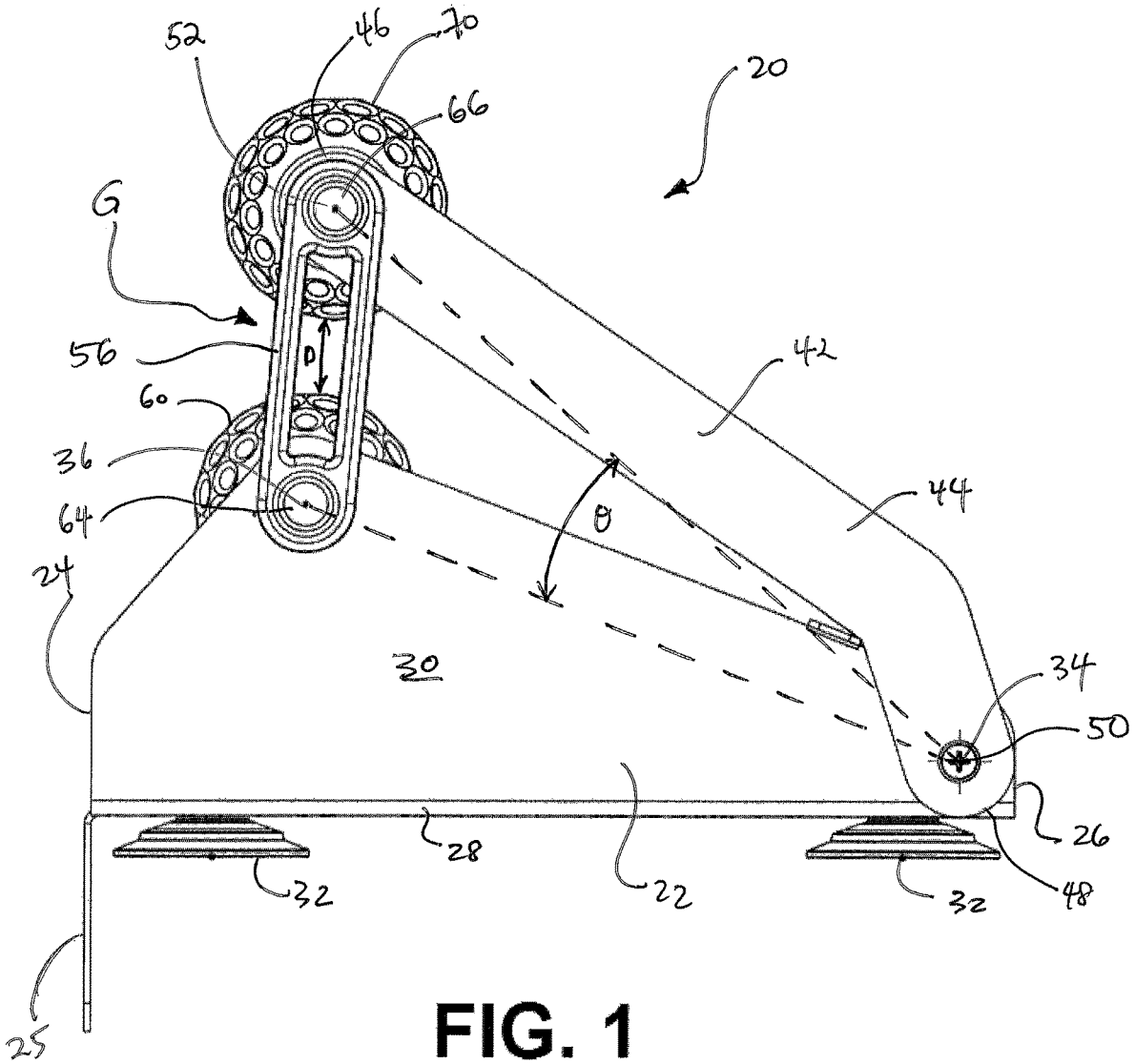
FIG. 1 is a side view of a limb rehabilitation device according to one embodiment of the present invention.

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

Figure 2:
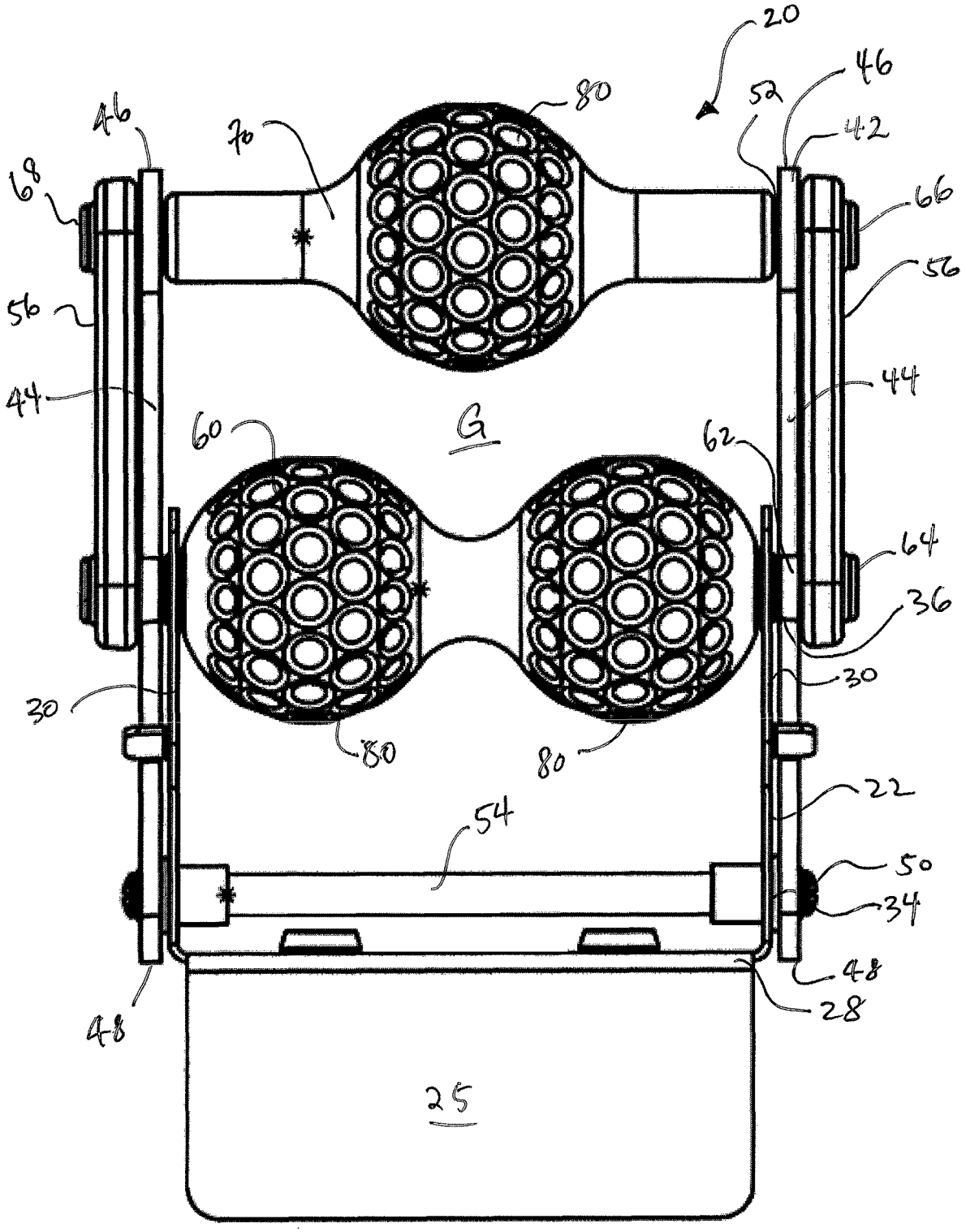
FIG. 2 is a front view of the limb rehabilitation device of FIG. 1.
Figure 3:
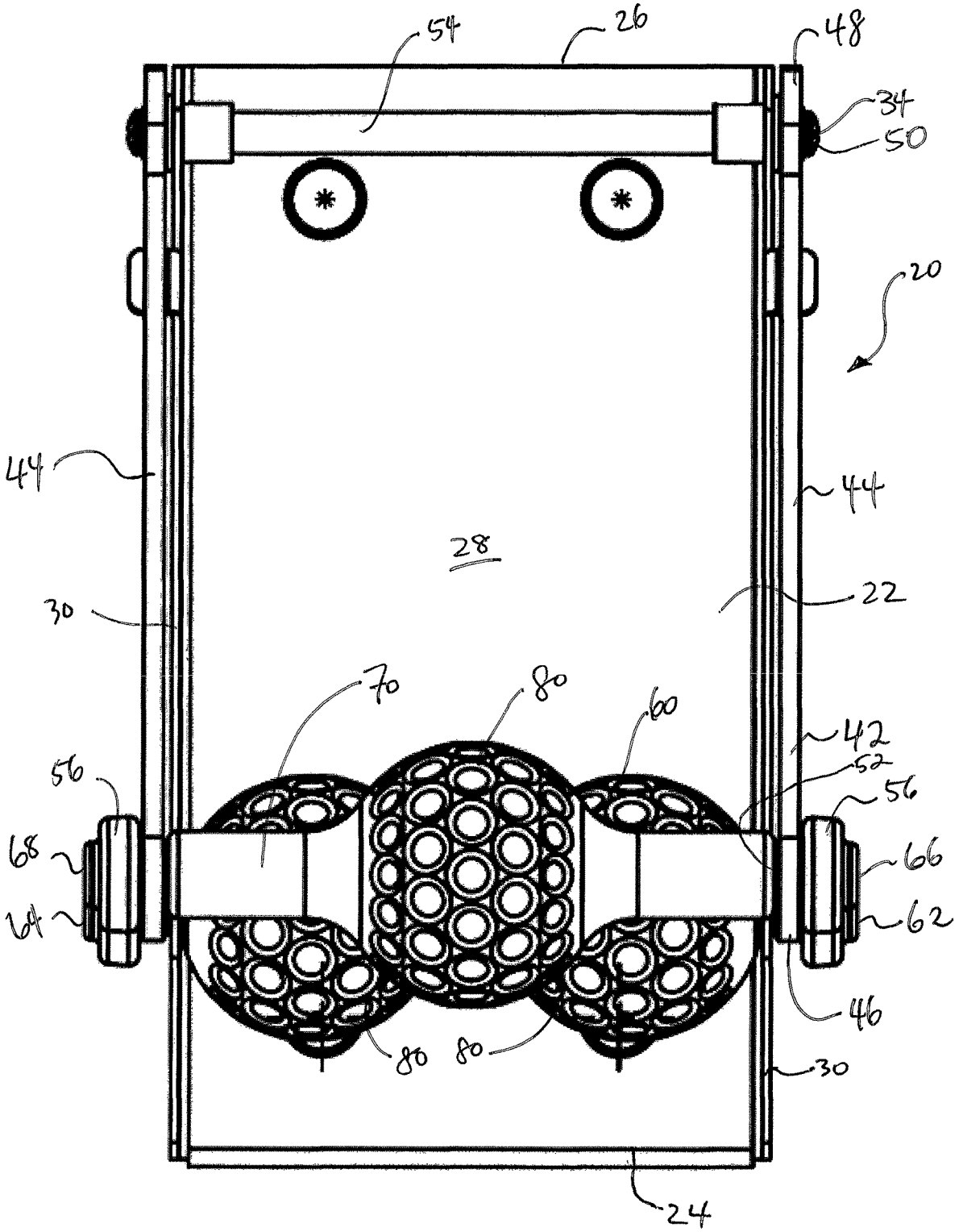
FIG. 3 is a top elevation view of the limb rehabilitation device of FIG. 1.

With reference to FIGS. 1 to 3, a limb rehabilitation device 20 according to one embodiment of the present invention is shown. The limb rehabilitation device 20 comprises a lower frame 22 having a front 24 and a rear 26, a base 28 extending between the front and rear. The base 28 has an upper surface, a lower surface, and two lengthwise sides. A side panel 30 is provided on each lengthwise side of the base 28 and the panel 30 extends substantially orthogonally from the upper surface, thereby providing the lower frame 22 with a roughly U-shaped cross-section when viewed from the front or the rear. While the side panel 30 is shown to substantially extend the entire length of the base 30, it is not necessary.

Grips 32, including for example rubber stoppers, suction cups, plastic grips, adhesives, clamps, and padding, may be provided on the lower surface of the base to enhance the frictional engagement of the base 28 with a surface on which the device is placed, such as a table. The device may be placed on a horizontal, inclined, or vertical surface. The device is preferably secured on to a flat surface by grips 32. In one example, the grips 32 are four suction cups, each being about 1.75" in diameter. In one embodiment, the front of the base 28 has a lip 25 extending from the lower surface, the lip being substantially orthogonally to the base. The lip 25 may help stabilize the device by serving as an anchor against an edge of the surface on which the device is placed.

The device 20 is substantially symmetrical about a central lengthwise axis of the base. Therefore, in this disclosure, when one side of the device is described, the description applies equally to the other side.

Side panel 30 provides two pivot points for the lower frame. A rear pivot point 34 is located near the rear 26 and a front pivot point 36 is located near the front 24. In a sample embodiment, as shown in FIGS. 1 and 2, the front pivot point 36 is further away from the upper surface of the base 28 than the rear pivot point 34.

Device 20 further comprises an upper frame 42 pivotably connected to the lower frame 22. In a sample embodiment, as shown in FIGS. 1 to 3, the upper frame has two arms 44, each forming a lengthwise side of the upper frame. Arm 44 has a first end 46 and a second end 48. Arm 44 provides two pivot points: a rear pivot point 50 near the second end 48 and a front pivot point 52 near the first end 46.

The rear pivot point 50 is connected to the rear pivot point 34 of the side panel 30 by a pivotable connection, such as a pin joint. In one embodiment, an axle 54 is provided and extends between the rear pivot points, which may provide additional structural integrity.

In one embodiment, an elastic member 56 is used to releasably connect the upper frame 42 and the lower frame 22 at front pivot point 52 and front pivot point 36, respectively. Elastic member 56 has an upper end and a lower end. The elastic member 56 has an upper hole near the upper end and a lower hole near the lower end, both of which are for matingly receiving a pin or an end of an axle therethrough.

Elastic member 56 acts as a spring (i.e. extendable and automatically retractable in the axial direction between the upper end and the lower end of the elastic member 56) and has a spring constant k. The elastic member 56 may be, for example, a spring, a rubber band, a polymer band, etc.

Lower frame 22 supports a lower roller 60 rotatably mounted inside the lower frame, in between the side panels 30. The lower roller is rotatable about a lateral axis extending between the front pivot points 36 of the side panels 30. In one embodiment, an opening is provided at the front pivot point 36 for receiving a pin or an end of an axle therethrough. The lower roller 60 may be mounted to the lower frame 22 via a pin joint or the like. In a sample embodiment, the lower roller is mounted a lower roller axle 62. Each end 64 of the lower roller axle is received through the opening of the front pivot point 36, and extends beyond the side panel.

Upper frame 42 supports an upper roller 70 rotatably mounted between arms 44. The upper roller is rotatable about a lateral axis extending between the front pivot points 52 of the arms 44. In one embodiment, an opening is provided at the front pivot point 52 for receiving a pin or an end of an axle therethrough. The upper roller may be mounted to the upper frame via a pin joint or the like. In a sample embodiment, the upper roller is mounted on an upper roller axle 66. Each end 68 of the upper roller axle is received through the opening of the front pivot point 52, and extends beyond the arm.

The upper frame and lower frame are connected at the front pivot points by inserting end 68 of the upper roller axle 66 and end 64 of the lower roller axle 62 into the upper hole and lower hole of elastic member 56, respectively. The upper hole and lower holes of elastic member 56 are sized to matingly receive ends 68 and 64, respectively, such that there is sufficient frictional engagement to allow the elastic member to extend and retract while maintaining the connection between the upper and lower frames.

Elastic member 56 is sufficiently stiff to maintain a distance D between the maximum circumferences of the upper and lower rollers, when the device is not in use. A gap G is formed in the space between the upper and lower rollers, as shown in FIGS. 1 and 2. An angle θ is also defined between the upper frame and the lower frame, between front pivot points 36 and 52 with the rear pivot point 34 being the focal point. When elastic member 56 is extended by force, distance D increases, angle θ increases, and gap G is enlarged. In addition, when elastic member 56 is extended by force, the elastic member reciprocates by providing an equal and opposite force.

In a further embodiment, elastic member 56 is removable and may be replaced with another elastic member having a different spring constant. In a sample embodiment, the device is operable with elastic members having three different spring constants: about 30 lbs, about 55 lbs, and about 85 lbs. The different elastic members are interchangeable. The elastic members may be colour coded to help distinguish between the different spring constants.

Figure 4:
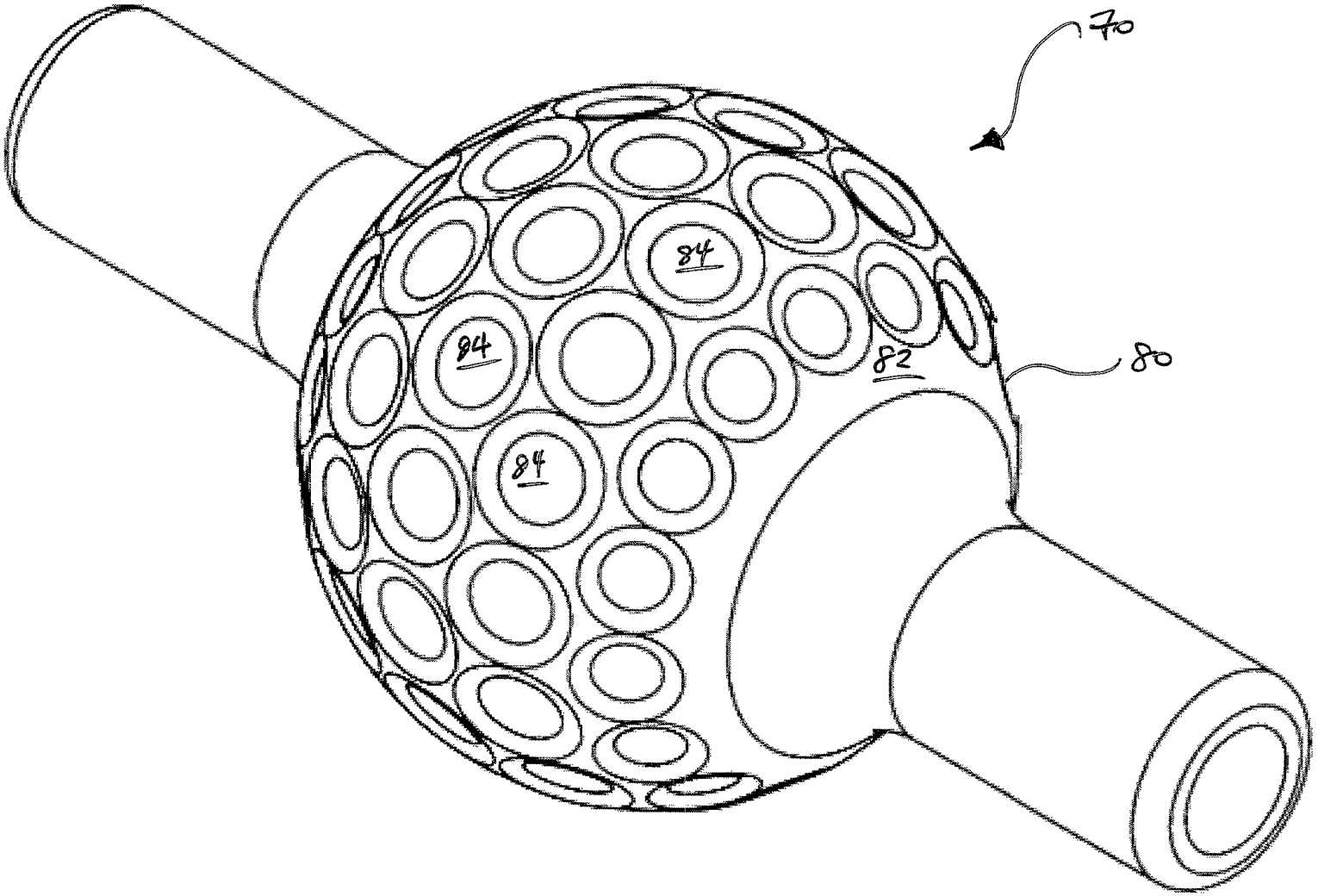
FIG. 4 is a perspective view of an upper roller of the limb rehabilitation device according to one embodiment of the present invention.

In the sample embodiment shown in FIGS. 1 to 6, the lower roller 60 includes two therapeutic components 80 (FIG. 5) and the upper roller has one therapeutic component 80 (FIG. 4). In other embodiments, each of the lower roller and upper roller may have one or more therapeutic components and the shape of the therapeutic component may be spherical, conical, cylindrical or any other shape. The therapeutic components 80 of the upper and lower rollers may have different shapes and need not be identical.

Figure 5:
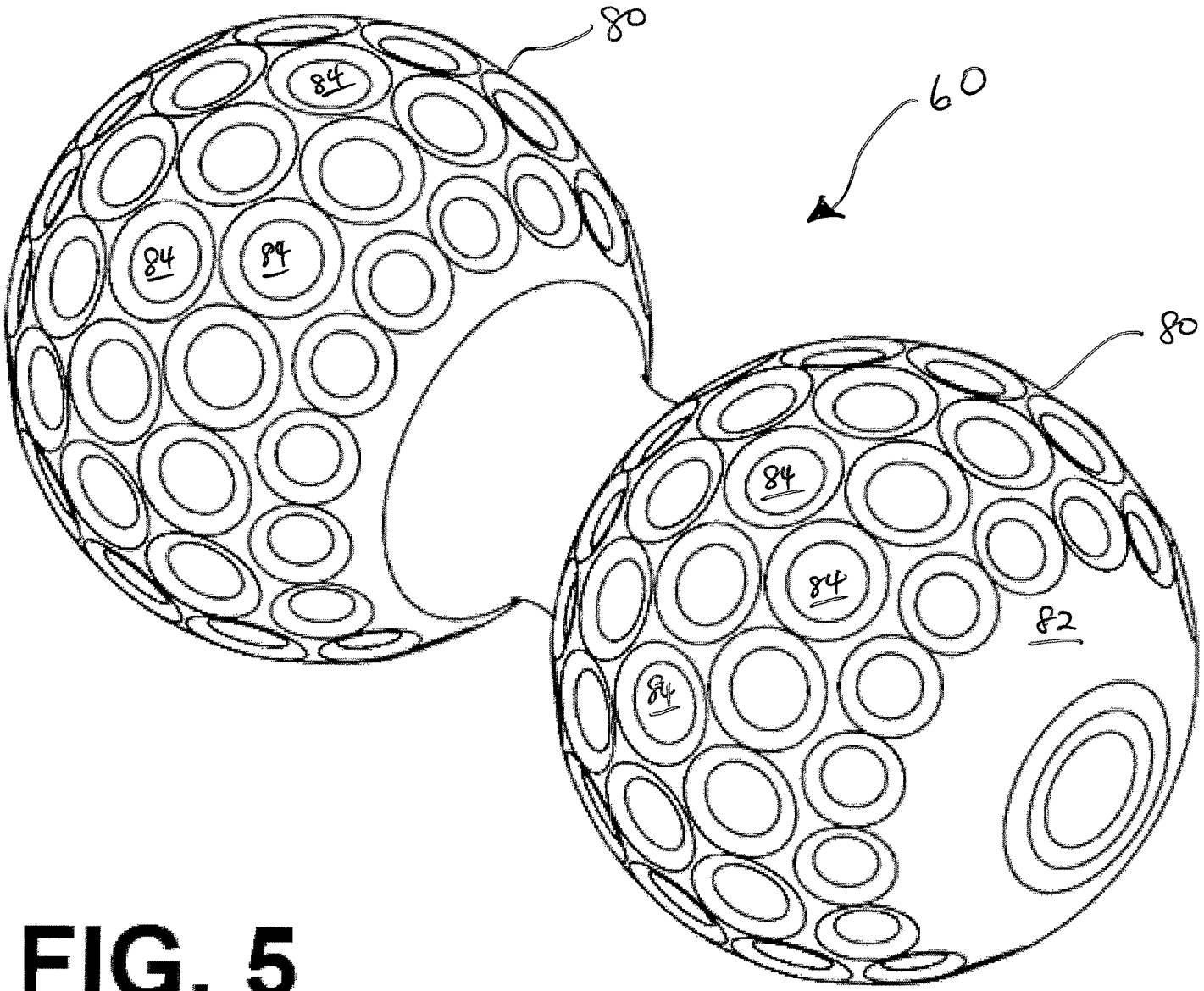
FIG. 5 is a perspective view of a lower roller of the limb rehabilitation device according to one embodiment of the present invention.
Figure 6:
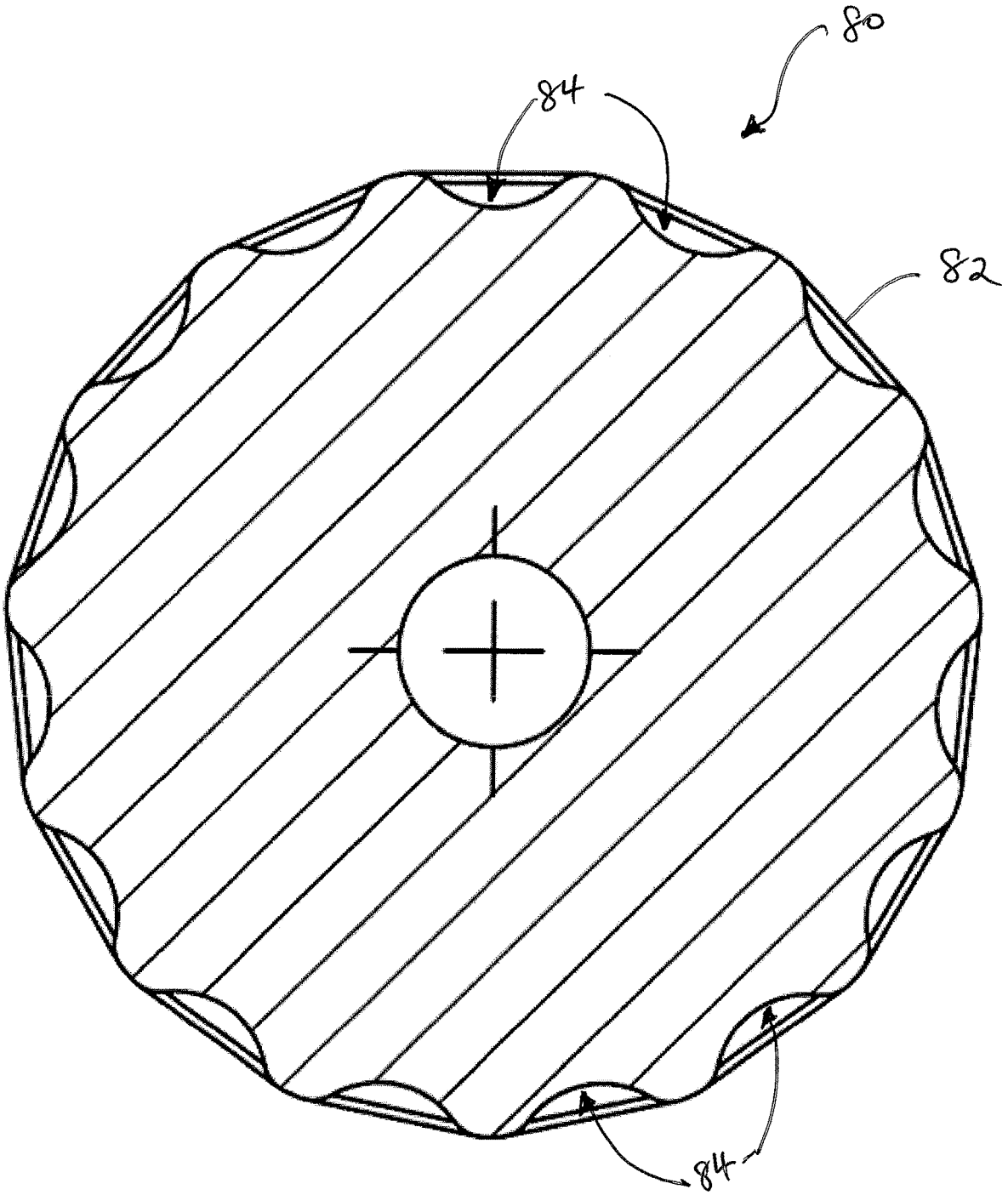
FIG. 6 is a cross-sectional view of one of the rollers shown in FIGS. 4 and 5.

In one embodiment, with reference to FIGS. 4 to 6, the therapeutic component 80 has a textured outer surface 82. In a sample embodiment, the texture is provided by a plurality of indents or dimples 84, similar to those on a conventional golf ball. In another sample embodiment, the texture is provided by a plurality of ridges and/or grooves (not shown) on the outer surface 82. The ridges and/or grooves may be angled relative to the central lengthwise axis of the base. The angle may range between about 30° and about 60°. In a still further sample embodiment, the texture may be provided by a plurality of knobs and/or bumps on the outer surface 82.

The textured outer surface may help generate a variety of forces on the skin, fascia, and superficial soft tissue when the device is in use. For example, the dimples 84 may generate suction on the skin by forming a temporary seal when pressed and rolled against the skin. The suction helps lift the skin, fascia, and superficial soft tissue. In another example, the above described angled ridges and/or grooves may produce a twisting and shearing force on the skin and soft tissue. In a further example, the above described knobs and/or bumps may help stretch the skin and soft tissue at the point of contact.

In one embodiment, each roller supports up to 6 therapeutic components 80 in series on the axle.

In the illustrated embodiment, the upper roller has one therapeutic component 80 ("upper component"). The lower roller has two therapeutic components ("lower components") in series on the axle 62. In this embodiment, the upper component is positioned to align with the lower components such that the upper component is substantially in between the lower components.

In one embodiment, the outer diameter of the therapeutic component ranges from 0.25" to 3". In a preferred embodiment, the outer diameter of the therapeutic component is about 1.9". The indents may be of various shapes, including for example partial-spherical, conical, frustoconical, cylindrical, etc. In a further embodiment, the therapeutic component has between about 6 and about 90 indents, each indented from the outer surface of the components by about 0.04" to about 0.5" at its deepest point. In a preferred embodiment, the therapeutic component has about three circumferential rows of 15 partial-spherical indents, each about 0.375" in diameter and about 0.088" deep, and two circumferential rows of 15 partial-spherical indents, each about 0.25" in diameter and about 0.088" deep. Of course, the therapeutic components can be configured, sized, and/or positioned according to a user's needs.

The device is made of materials that are suitable for use on human skin (e.g. non-toxic) and are durable and can withstand a range of forces. For example, the therapeutic components are made of High Density Polyehylene (HDPE) and the upper and lower frames are made of steel. The device and its components may be made via various methods. For example, the frames, the axles, and the therapeutic components may be manufactured by injection molding.

In a preferred embodiment, any part of the device that may come into contact with a user's skin during treatment (i.e. the frames, therapeutic components, axles, etc.) may be cleaned using alcohol or another disinfectant, in an autoclave, and/or under UV light. The elastic members may be removed during the cleaning of the parts of the device, as the elastic members do not usually come into contact with skin. Optionally or additionally, the therapeutic components are disposable for ease of maintaining hygiene.

In a sample embodiment, a user's forearm is inserted into the space G by first inserting his hand and wrist, and then the user moves his forearm back and forth in between the upper and lower rollers. As the user inserts his hand, wrist, and/or forearm in between the rollers, the rollers are pushed apart, thereby increasing the distance D and exerting a force on elastic members 56. The elastic members 56 respond to the force with an equal and opposite force, which helps the rollers maintain contact with the user's hand, wrist, and forearm as they move in between the rollers.

In a preferred embodiment, the position of the upper component is substantially aligned with the major superficial muscles of the posterior forearm including the extensor digitorum or the flexor carpi ulnaris. Further, the lower components are preferably positioned to align with the major superficial muscles of the anterior forearm including the brachioradialis and flexor carpi radialis. The therapeutic components are preferably positioned to avoid excessive compression of the median nerve, the radial artery or the bony prominences of the wrist or the elbow in order to minimize irritation of these areas.

In an optional embodiment, a limb may be placed in between the upper and lower rollers by: first, separating the upper roller from the lower rollers by releasing one or both of the elastic members; second, placing the limb on the lower roller; and third, reconnecting the upper and lower frames at the front pivot points 52 and 36 by reattaching the released elastic member(s). This method may be useful in a situation where inserting the limb by first inserting a nearby anatomy between the rollers is not possible or would cause discomfort (e.g. due to sensitivity, injury, presence of a cast, etc.)

To set up the limb rehabilitation device, a pair of elastic members is selected based on the size, strength, and the condition (e.g. extent of injury) of the limb to be treated. Elastic members with a high spring constant may provide a higher intensity treatment, and vice versa. The pair of elastic members is fitted on to the device at front pivot points 52 and 36 to connect the ends 64 and 68 of the upper and lower axles. The limb rehabilitation device may be secured to almost any flat surface (e.g. a table top) using grips 32. The device may be positioned on the surface with lip 25 abutting against the edge of the surface.

To use the device after it is set up, a user's limb (e.g. hand, wrist, and/or forearm) is inserted into the space G, either from the front or the rear of the device. In a preferred embodiment, the limb is inserted from the front to allow the lip 25 to better anchor the device. The limb is pushed further into the device and positioned relative to the therapeutic components until the therapeutic components are in contact and substantially aligned with the areas of the limb that require massage and/or treatment. Preferably, the user adjusts the position of the limb relative to the therapeutic components to avoid excessive contact with sensitive, delicate, and/or irritated areas of the limb. Once positioned, the limb is moved back and forth in between the upper and lower rollers. The repeated contact of the therapeutic components on the limb, from the back and forth movement thereof, may provide compression, stretching, and/or lifting of the skin, fascia, and/or superficial soft tissue of the limb. When the treatment session is completed, the limb may be: (i) pulled out of the space G; (ii) re-positioned relative to the therapeutic components for a further treatment session; and/or (iii) reinserted into the space G for a further treatment session after the elastic members are replaced with ones with a different spring constant.

While the limb rehabilitation device has been described with respect to treatment of the forearm, the device may be used to treat other areas of the body.

In yet another embodiment, the grips 32 may be handles for treating, for example, an upper arm, lower leg, or upper leg. Instead of moving the limb back and forth between the rollers, the handles may be used by the user or another person (e.g. a masseuse or therapist) to manually move the device repeatedly over the limb during treatment.

In a still further embodiment, each frame may have more than one axle, and each axle may have one or more therapeutic components mounted thereon. Multiple axles and therapeutic components may give greater stability during treatement, particularly for larger limbs such as a leg.

Figure 7:
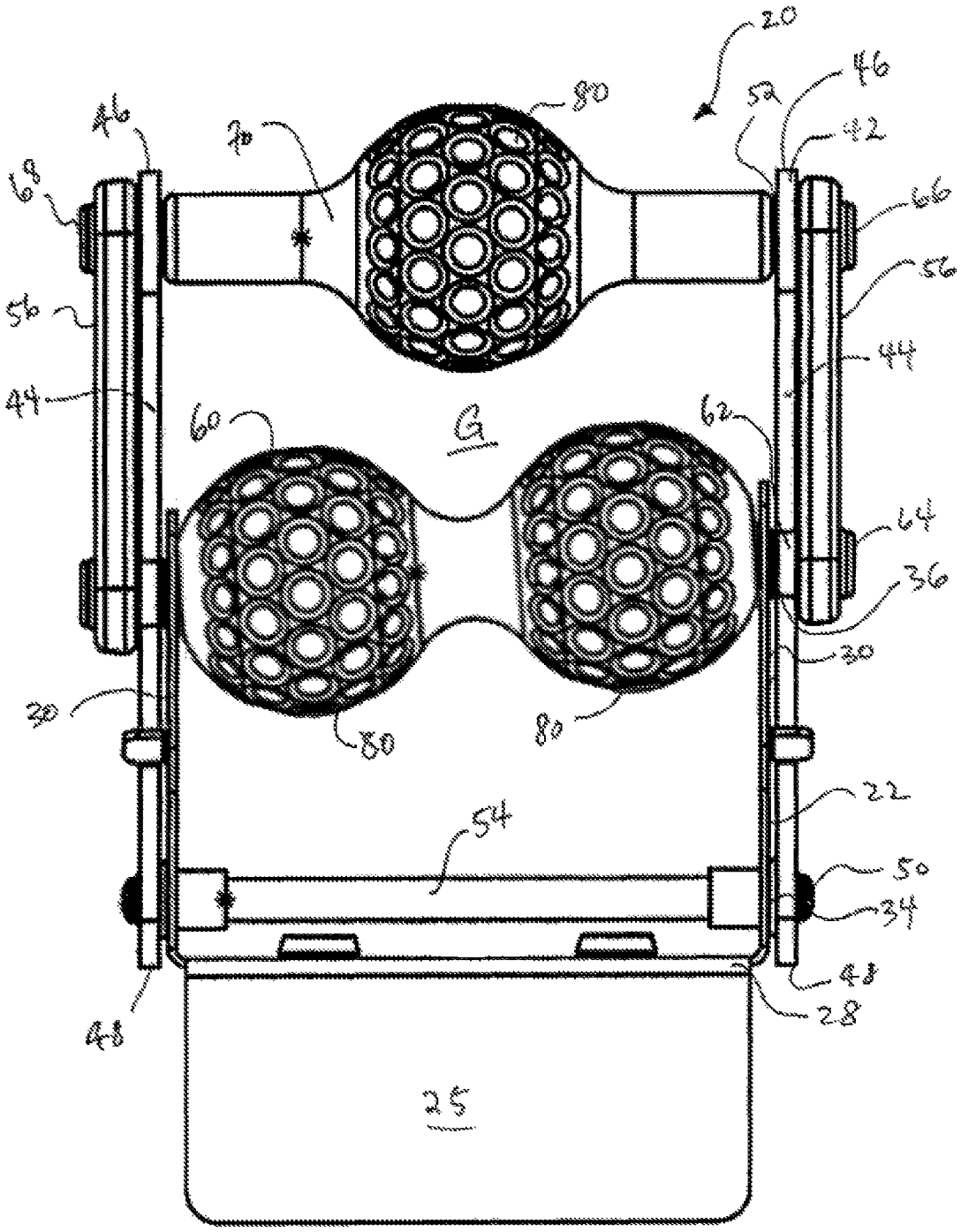
FIG. 7 is a front view of a limb rehabilitation device according to one embodiment of the present invention.

The axles do not necessarily have to be parallel to one another. As shown in FIG. 7, axles that are positioned at an angle to each other may produce twisting and torsion in the skin and soft tissue of the limb, while the limb moves back and forth therebetween. This motion may replicate the bowing, twisting, and wringing motions used during massage therapy to promote fascia adhesion release, as described in the website www.massagetherapy101.com.

In an optional embodiment, the device may be heated or cooled before and/or during use.

The therapeutic components may be mounted on the axles to resist, to some extent, the rotation thereof. In other words, a certain amount of force is required to move the therapeutic components to allow the limb to proceed through in between the frames. The resistance of the therapeutic components may be provided by viscous bearings. The therapeutic components may be configured to have different amounts of resistance and/or to be progressively easier to rotate once in motion. The use of therapeutic components with resistance may result in a pin-and-stretch motion in the skin and the soft tissue to help lengthen muscles and increase muscle mobility.

In a further embodiment, the device may include a counter to track the number of rotations of the therapeutic components, which may assist in following a specific and/or prescribed treatment regimen.

Optionally, the therapeutic components may be made of a soft material and/or filled with fluid. This may provide a larger drag area for contacting the limb to aid circulation, reperfusion, and traction in the soft tissue, which may be useful in treating swelling and edema.

A lubricating liquid (e.g. oil) may be applied to the skin of the limb before treatment. In one embodiment, the lubricating liquid may have cooling or warming effects on the limb.

In a further embodiment, an adhesive may be applied to the skin of the limb before treatment, to help increase the lifting of the soft tissue. This may be helpful in treating elderly and/or obese people, whose underlying muscle is likely too deep to be accessible by direct soft tissue manipulation.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A limb rehabilitation device comprising:

a base for demountably engaging a surface, the base defining a front side and a rear side along the surface, and an upward direction perpendicular to the surface;

a first frame having a front portion directly extending upwardly from about the front side of the base and a rear portion directly extending upwardly from about the rear side of the base, the first frame comprising at least one first therapeutic component rotatably supported on the front portion thereof and rotatable about a first rotational axis;

a second frame having a front portion about the front side of the base and a rear portion about the rear side of the base with the rear portion thereof rotatably coupled to a pivot point at the rear portion of the first frame, the second frame comprising at least one second therapeutic component rotatably supported on the front portion thereof and rotatable about a second rotational axis, said at least one second therapeutic component being in a vertical arrangement with respect to said at least one first therapeutic component; and at least one elastic member elastically coupling the front portion of the first frame to the front portion of the second frame;

wherein the first rotational axis of the at least one first therapeutic component is further away from a horizontal plane defined by the base than the pivot point of the first frame from the horizontal plane.

2. The device of claim 1, wherein the at least one elastic member, when in a first, unextended position, maintains a distance (D) between maximum circumferences of the at least one first and the at least one second therapeutic components.

3. The device of claim 2, wherein the at least one elastic member is extendable by force to a second position having a distance greater than (D) between said maximum circumferences of the at least one first and the at least one second therapeutic components.

4. The device of claim 3, wherein when the at least one elastic member is extended by force to the second position, the at least one elastic member reciprocates by providing an equal and opposite force.

5. The device of claim 1, wherein the at least one elastic member is removable and replaceable with at least one alternate elastic member having different spring constants.

6. The device of claim 5, wherein the at least one alternate elastic member of different spring constants are colour coded.

7. The device of claim 1, wherein the shape of each of the at least one first and the at least one second therapeutic components is selected from the group consisting of spherical, conical, cylindrical and combinations thereof.

8. The device of claim 1, wherein the at least one first and the at least one second therapeutic components have different shapes.

9. The devices of claim 1, wherein the first frame comprises two therapeutic components and the second frame comprises one therapeutic component.

10. The devices of claim 1, wherein each of the at least one first and the at least one second therapeutic components have a textured outer surface.

11. The device of claim 1, wherein at least a first one of the at least one first and the at least one second therapeutic components is configured to align with the major superficial muscles of the posterior forearm of a user.

12. The device of claim 1, wherein at least a second one of the at least one first and the at least one second therapeutic components is configured to align with the major superficial muscles of the anterior forearm of a user.

13. The device of claim 1, further comprising one or more handles on one or both of the first frame and the second frame and wherein the one or more handles are graspable and configured to manually move the device over a limb to be rehabilitated.

14. The device of claim 1, wherein each of the first and second frames comprise more than one therapeutic components mounted on one or more rotational axis.

15. The device of claim 1, wherein the first and the second rotational axes have orientations selected from parallel to one another and non-parallel to one another.

16. The device of claim 1, wherein the at least one first and the at least one second therapeutic components are mounted on the respective first and second rotational axes to at least partially resist rotation thereof.

17. The device of claim 16, wherein rotational resistance of the at least one first and the at least one second therapeutic components is provided by viscous bearings.

18. The device of claim 16, wherein each of the at least one first and the at least one second therapeutic components is configured to have a different rotational resistance from one another.

19. The device of claim 16, wherein rotational resistance progressively diminishes with rotation of the at least one first and the at least one second therapeutic components.

20. The device of claim 1, wherein the at least one first and the at least one second therapeutic components are made of a soft material and/or filled with fluid.

21. The device of claim 1, wherein the first frame is separable from the second frame by releasing one or more of the at least one elastic member.

22. The device of claim 1 further comprising at least one of:

a plurality of grips coupled to a bottom of the base for frictional engagement of the base with the surface; and a lip downwardly extending from the base for abutting against an edge of the surface for stabilizing the device on the surface.

23. The device of claim 1, wherein the at least one elastic member comprises one or more of a spring, a rubber band, and a polymer band.

24. The device of claim 1, wherein the first frame comprises at least two first therapeutic components; and wherein the at least two first therapeutic components and the at least one second component are positioned such that the at least one second component is substantially in between the at least two first therapeutic components.

25. A limb rehabilitation device comprising:

a base for demountably engaging a surface;

a supporting structure having a first frame having a front portion directly extending upwardly from about a front side of the base and a rear portion directly extending upwardly from about a rear side of the base and a second frame rotatably coupled to the first frame at a pivot point thereof;

at least one first therapeutic component rotatably coupled to said first frame at a location longitudinally spaced from the pivot point and further away from a horizontal plane defined by the base than the pivot point of the first frame from the horizontal plane;

at least one second therapeutic component rotatably coupled to said second frame, said at least one second therapeutic component being in a vertical arrangement with respect to said at least one first therapeutic component; and at least one elastic member coupled to the first and the second frames for elastically maintaining a minimum distance (D) between the at least one second therapeutic component and the at least one first therapeutic component;

wherein the at least one second therapeutic component is movable relative to the at least one first therapeutic component.

* * * * *